US005706696A

United States Patent [19]

Wagner

[11] Patent Number: 5,706,696

[45] Date of Patent: Jan. 13, 1998

[54] MODULAR PRESSURE SET AND SYSTEM FOR STAMPING PRESS

[76] Inventor: Wendell J. Wagner, 8636 Plainwell, Gregory, Mich. 48137

[21] Appl. No.: 707,855

[22] Filed: Sep. 9, 1996

[51] Int. Cl.[6] ..... B21D 22/00; B21D 22/21; B21J 9/18

[52] U.S. Cl. ..... 72/351; 72/453.13; 251/207

[58] Field of Search ..... 72/350, 351, 453.13, 72/413, 412; 251/207, 209

[56] References Cited

U.S. PATENT DOCUMENTS

| | | | |
|---|---|---|---|
| 3,558,100 | 1/1971 | Hulsey | 251/207 |
| 3,700,003 | 10/1972 | Smith | 251/207 |
| 3,751,956 | 8/1973 | Blanchi | 72/351 |
| 4,266,571 | 5/1981 | Bauder | 251/209 |
| 4,471,808 | 9/1984 | Thomsen et al. | 251/209 |
| 5,009,393 | 4/1991 | Massey | 251/207 |
| 5,241,849 | 9/1993 | Baur | 72/351 |
| 5,339,665 | 8/1994 | Yoshikawa | 72/351 |
| 5,435,165 | 7/1995 | Sunada | 72/351 |

OTHER PUBLICATIONS

Forward Industries—Nitrogen Die Cylinder Systems Catalog #FL-106 Jul. 1991.

Anchor—Ball Bearing Die Sets—Catalog No.BB93.

Enertrols, Inc.-Industrial Hydraylic Shock Absorbers Circle 607.

Ace Controls, Inc.- Ace 52-4-94 p. 8.

Raymond Kaller-Nitrogen Gas Springs ©1993 Barnes Group, Inc. RK400.

*Primary Examiner*—Lowell A. Larson
*Assistant Examiner*—Rodney A. Butler
*Attorney, Agent, or Firm*—Dykema Gossett PLLC

[57] ABSTRACT

A pressure set for use in a stamping press has a pressure cylinder placed between an upper and lower plate of the pressure set. In addition, an adjustable pressure regulating means is coupled to the cylinder for changing the pressure applied between the upper and lower plates. A controller coupled to the adjustable pressure regulator adjusts the pressure in the pressure cylinder to provide a predetermined pressure between the upper and lower plates.

35 Claims, 3 Drawing Sheets

MODULAR PRESSURE SET AND SYSTEM FOR STAMPING PRESS

BACKGROUND OF THE INVENTION

1. Technical Field

The present invention relates generally to a pressure set for a metal stamping press, and more particularly, to a method and apparatus for providing an adjustable pressure set for supporting a die.

2. Discussion of the Related Art

The use of metal stamping presses to stamp sheet material into various parts is well known. Although many aspects of stamping art have been well developed, further improvements are still desirable to improve efficiency.

A typical press contains a ram positioned above a bed plate. An upper die is mounted to the ram above a lower die that is placed on the bed plate. The shape of the die determines the part shape. A sheet of material to be formed is placed between the upper die and the lower die. The press ram forces the upper die against the lower die to form the material into the desired shape.

To lessen damage to each die due to the impact of the upper die against the lower die and to provide pressure to hold the sheet metal in place for part formation, the lower die is placed on a pressure pad. Pressure systems are commonly used to provide a source of predetermined pressure resistance to the lower die. As the upper die impacts the lower die, the upper die is decelerated in a controlled manner. Each pressure system is calibrated for the particular part to be formed to provide the proper pressure resistance and holding capabilities.

Because a stamping press is so expensive, a manufacturing facility typically uses the same press to stamp a number of parts. Each part has an upper and lower stamping die and a pressure components that must be inserted into the die for each new part.

Both the stamping dies and the pressure systems are very costly. Providing different stamping dies for different parts is unavoidable. Providing a common pressure system for each part was also believed unavoidable since each pressure system was calibrated to provide the required pressure for the particular part to be stamped. Removing the pressure system from the press increases the time to reconfigure the press when a new part is to be manufactured, requires storage space and requires capital investment in a new pressure system for each new part. It would therefore be desirable to eliminate the need for individual pressure components for each part to be stamped on a press.

SUMMARY OF THE INVENTION

One advantage of the present invention is that only one pressure set needs to be provided for a press. The advantage is really two-fold. First, the capital cost is much lower since only one pressure set needs to be provided and none have to be stored when not in use. Second, the time required to change the die is reduced since the pressure set does not have to be removed to form a new part.

In one embodiment of the present invention, a pressure set has an upper plate and lower plate. Between the upper pressure set plate and lower pressure set plate, at least one pressure cylinder is placed between upper pressure set plate and lower pressure set plate. Also, an adjustable pressure regulating means is coupled to the cylinder for changing the pressure applied between upper and lower pressure set plate. A controller is coupled to the adjustable pressure regulator to adjust the pressure regulator to provide a pre-determined amount of pressure between the upper and lower pressure set.

One feature of the present invention is that the pressure set may be modularized. That is, several individual pressure sets may be placed adjacent to each other in a frame. Each individual pressure set may have a different pressure. To facilitate easy adjustability a computer may be used to set each module to the desired pressure.

In another aspect of the invention, the method for utilizing a pressure set includes placing a pressure set on a bed plate. The pressure set has a module with an adjustable pressure cylinder. Then die is placed on the pressure set. Then, the adjustable pressure cylinders are remotely adjusted to provide a predetermined pressure to the die during stamping of a part. When a new part is to be stamped, the pressure cylinders are then readjusted.

BRIEF DESCRIPTION OF THE DRAWINGS

Other advantages of the present invention will become apparent from the following detailed description which should be read in conjunction with the drawings in which.

DETAILED DESCRIPTION OF THE PREFERRED EMBODIMENT

Figure 1:
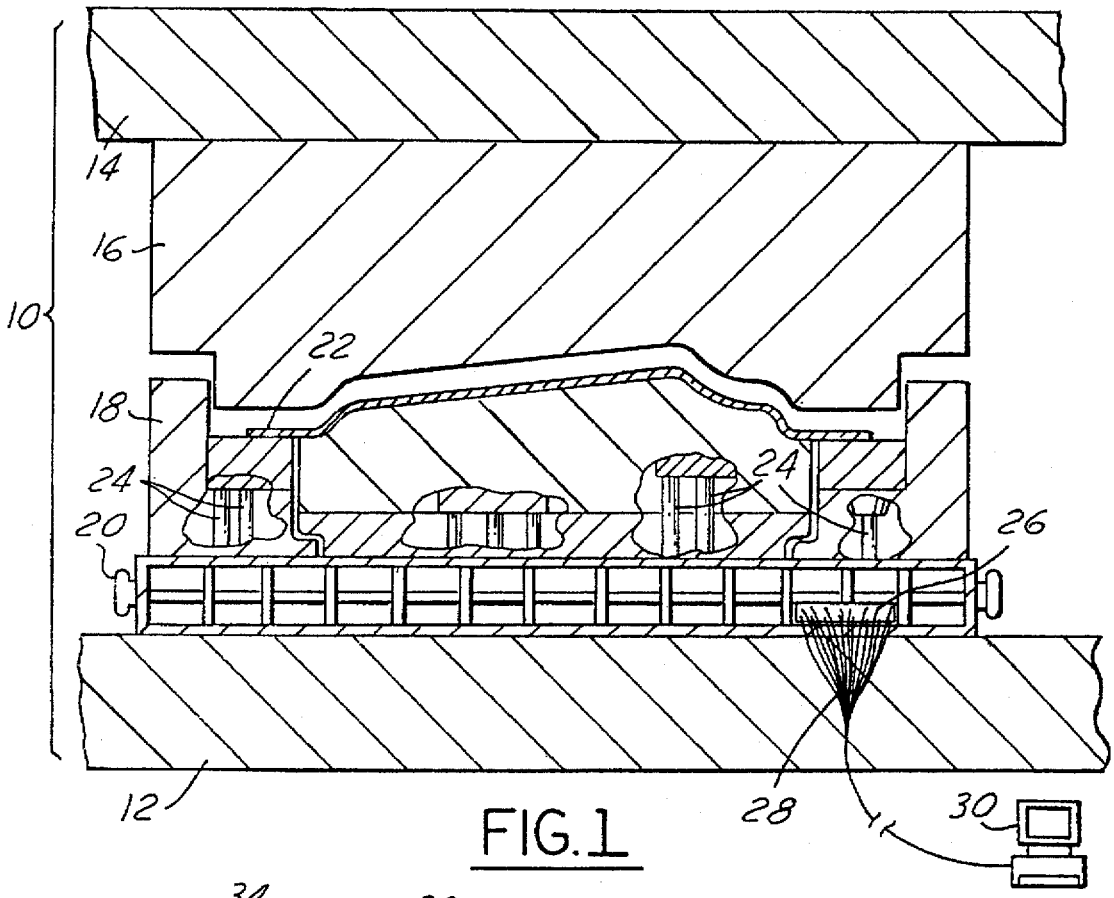
FIG. 1 is a cross sectional view of a metal stamping press, die and pressure set according to the preferred embodiment of the invention.

Referring now to the drawings, like reference numerals are used to identify identical components in the various views. Although the invention will be described and illustrated in the context of a metal stamping press, it will be appreciated that this invention may be used in conjunction with other applications requiring an adjustable pressure set.

FIG. 1 shows the major mechanical components of a press 10. Press 10 has a bed 12 and a ram 14. Components removable from press 10 include an upper die 16, a lower die 18 and a pressure set 20. For a particular part 22 to be stamped, pressure set 20 is placed on bed 12. Lower die 18 is placed upon pressure set 20 and upper die 16 is secured to ram 14. The material to be formed is placed between upper die 16 and lower die 18. Ram 14 provides the force to move upper die 16 against lower die 18 and form the material into part 22.

Lower die 18 has a plurality of pressure pins 24. Pressure pins 24 support lower die 18 on pressure set 20. The placement of pressure pins 24 depends on the shape of part 22 to be formed. Pressure pins 24 correspond to places on the lower die 18 where pressure resistance to the force of ram 14 is required to obtain the proper formation of part 22 to be formed.

Pressure set 20 has an externally adjustable pressure to support lower die 18. The entire pressure set 20 may have a pressure adjustable as a single unit. Pressure set 20 may also be comprised of individual modules each having adjustable pressures that may be varied with respect to the other modules.

A connector 26, wires 28 and a computer 30 are used to communicate to pressure set 20 to change the pressure provided by pressure set 20. The selected pressure that pressure set 20 is to apply may be entered in computer 30 and communicated to pressure set 20 through wires 28.

Figure 2:
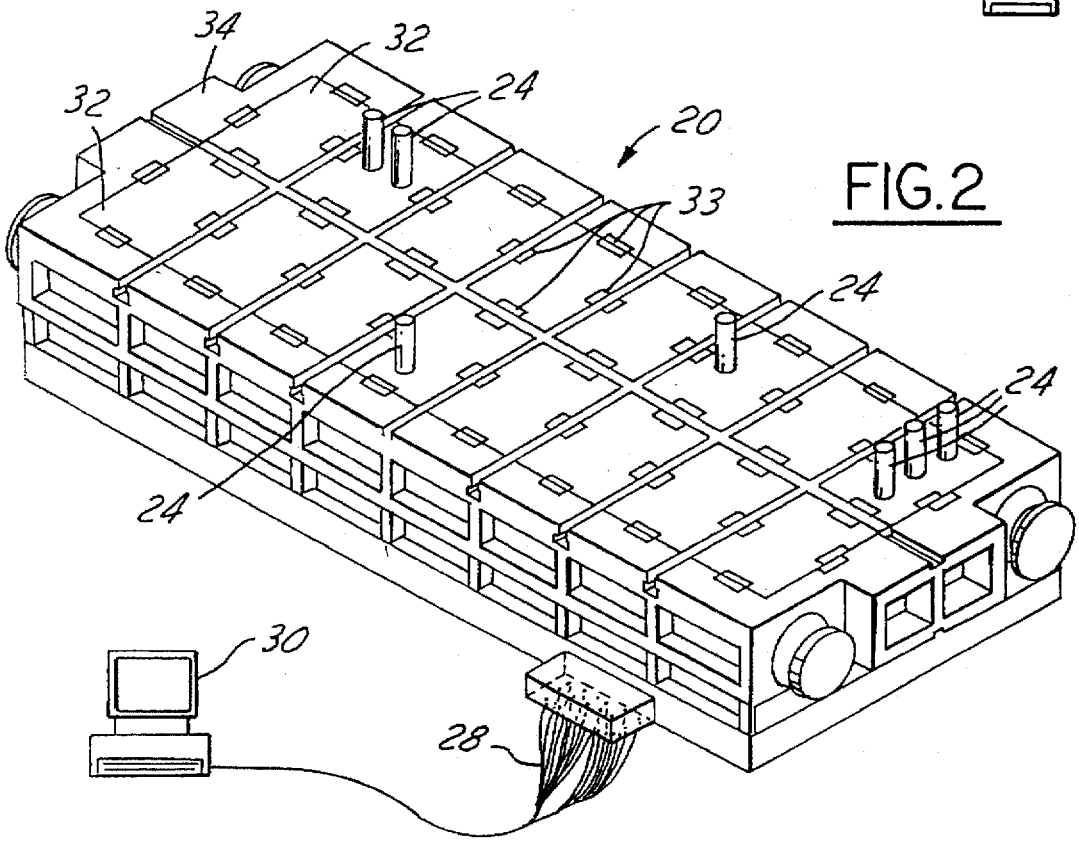
FIG. 2 is a isometric view of a pressure set according to the present invention.

Referring now to FIG. 2, a pressure set 20 is shown having individual modules 32 housed within a support frame 34. Each module 32 may have a pressure that is individually controllable. The only modules 32 that actually need be controlled are modules 32 having at least one pressure pin 24 since these modules 32 are the only modules 32 that are needed to provide resistance to the force of the ram acting upon the die supported by pressure pins 24. Wear plates 33 may be provided between the individual modules to prevent contact between the modules and prevent wear. Wear plates 33 are common in the industry.

Figure 3:
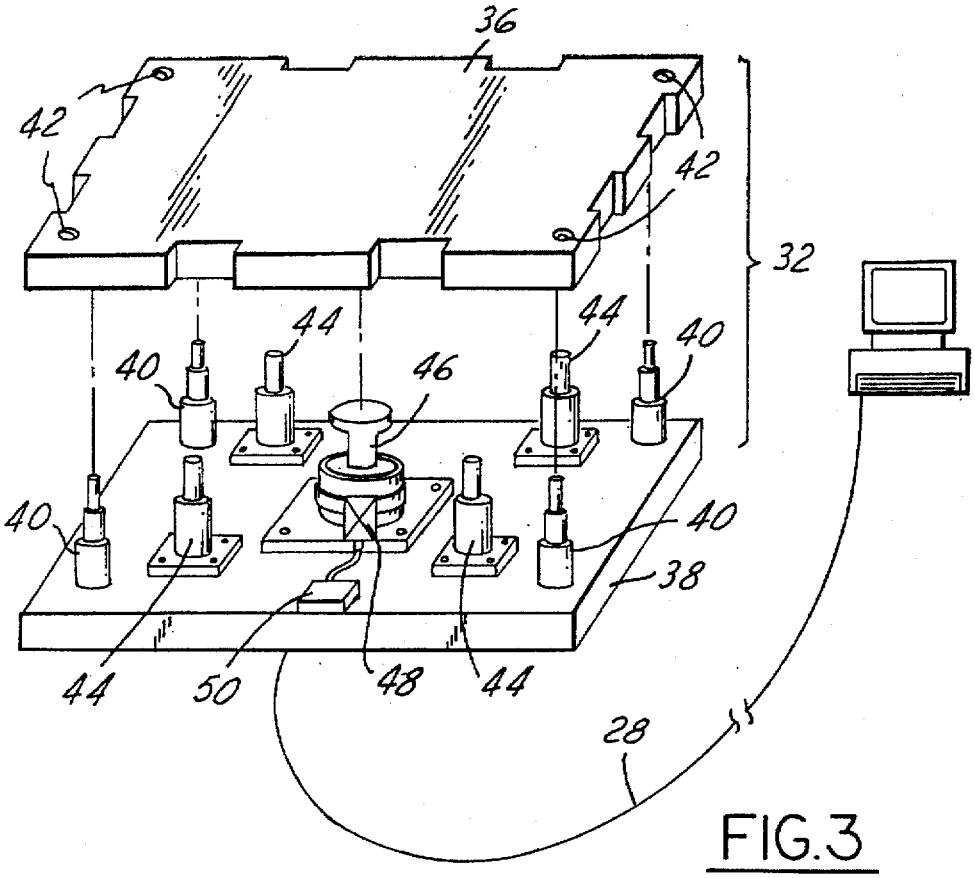
FIG. 3 is an isometric view of the inside of a pressure set according to the present invention.

Referring now to FIG. 3, an individual module is shown in detail. Module 32 has an upper plate 36 and a lower plate 38 between which load beating components are placed to provide the desired pressure. Each module 32 may include die set bushings 40, nitrogen die cylinders 44 and an adjustable pressure cylinder 46.

Die set bushings 40 are preferably located at each corner of module 32. Die set bushings 40 are mounted to lower plate 38 and are mounted into holes 42 in upper plate 36. Die set bushings 40 help to maintain upper plate 36 and lower plate 38 as a unit during stamping. Pressure set bushing 40 may be of a type common in the industry such as a ball bearing type. An assembly of upper plate 36, lower plate 38 and pressure set bushing 40 may be similar to a type that may be purchased from Anchor Die Supply, Inc. of Madison Heights, Mich. to the specifications required for the particular operation.

Each module 32 may contain a plurality of die cylinders 44. Die cylinders 44 provide some pressure between upper plates 36 and lower plates 38 particularly for distributing the load. Die cylinders 44 may be a number of common pressure providing means such as a spring, die rubber, air cushion or nitrogen die cylinder. After stamping, die cylinders 44 are used to provide a return force to move upper plate 36 to its before-stamping position. A pump or other means known in the art may be used to return upper plate 36 to its before-stamping position.

Each module 32 has an adjustable pressure cylinder 46. Adjustable pressure cylinder 46 ultimately controls the pressure between upper plate 36 and lower plate 38. An adjustable pressure regulator means 48 is connected to adjustable pressure cylinder 46 to provide a predetermined pressure between upper plate 36 and lower plate 38. The adjustable pressure regulator means 48 preferably includes a motor (shown in FIG. 4) that uses a servo control 50 to provide commands to move the motor and in turn adjust adjustable regulator means 48. Servo control 50 is connected to computer 30 through wires 28.

Figure 4:
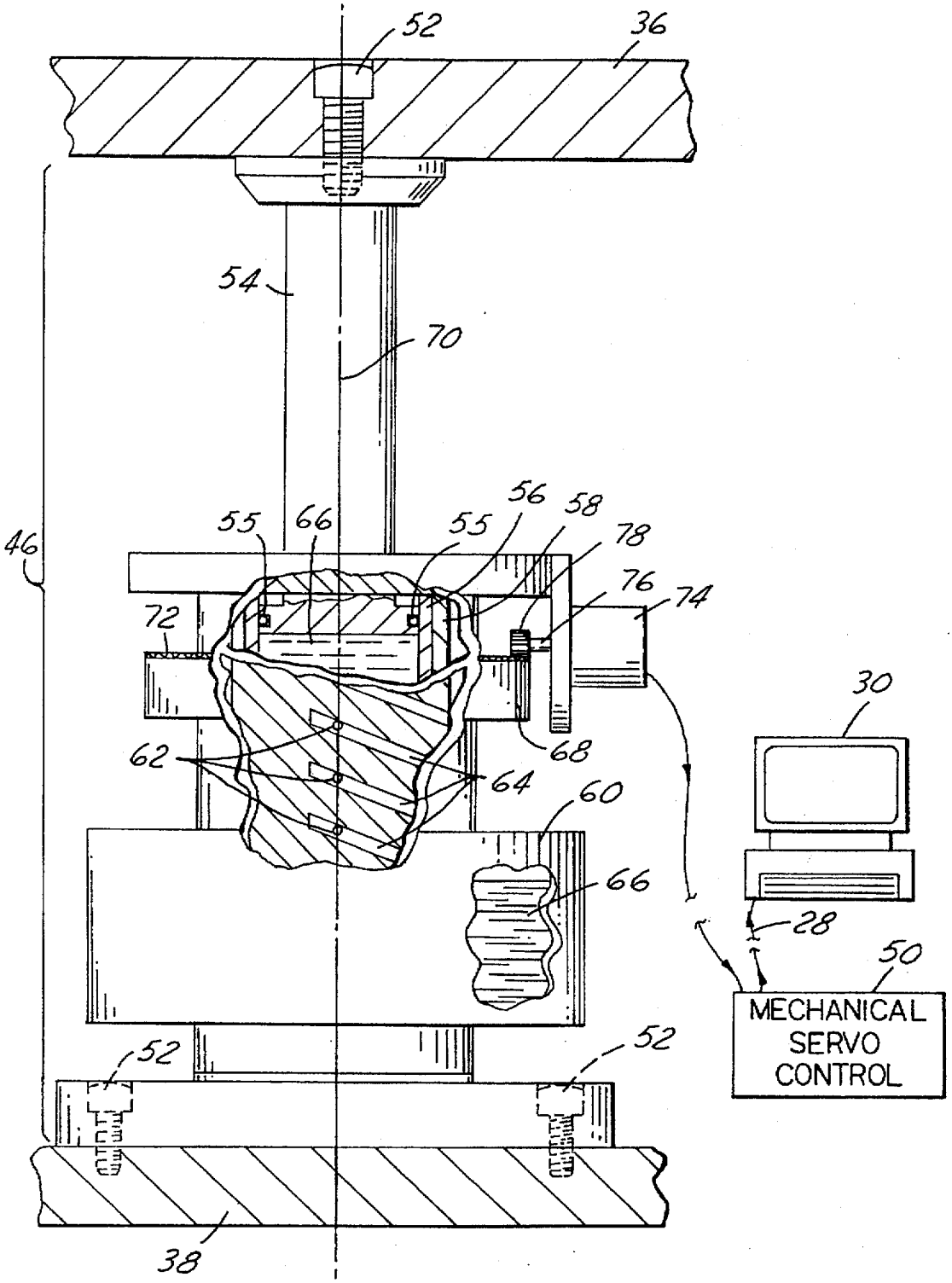
FIG. 4 is a partial cut-away view of an adjustable pressure cylinder according to the present invention.

Referring now to FIG. 4, adjustable pressure cylinder 46 is secured to upper plate 36 by a fastener 52 such as a screw or a bolt. Preferably fastener 52 is removable. A fastener 52 may also be used to secure adjustable pressure cylinder 46 to lower plate 38. Adjustable pressure cylinder 46 is preferably similar to a type manufactured by Ace Controls, Inc. of Farmington, Mich.

Adjustable pressure cylinder 46 comprises a piston 54 having a seal 55. Piston 54 has an end which rests against upper plate 36. Within adjustable pressure cylinder 46 is an internal pressure adjuster that preferably uses an inner tube 56 an outer tube 58 and an accumulator 60. Inner tube 56 has orifice holes 62. Outer tube 58 has slots 64. When piston 54 is in the extended position hydraulic fluid 66 is also contained within inner tube 56. When pressure is applied to upper plate 36, piston 54 is pushed into inner tube 56 and forces hydraulic fluid 66 through orifice holes 62 and out slots 64 at a controlled rate. The pressure supplied to upper plate 36 is regulated by the controlled rate which in turn depends on the alignment of orifice holes 62 with slots 64. As plate 36 pushes piston 54 down, hydraulic fluid is forced through orifice holes 62 and through slots 64 into accumulator 60. Outer tube 58 moves relative to inner tube 56 so that the area of the holes 62 aligned with slots 64 may be changed. After stamping nitrogen cylinders 44 or other means may be used to extend the piston and draw the hydraulic fluid back within inner tube 56.

Inner tube 56 and outer tube 58 is preferably externally adjustable. An adjustment ring 68 preferably rotates about an axis 70. Preferably axis 70 is the central axis of piston 54 inner tube 56 and outer tube 58. Adjustment ring 68 is preferably linked to outer tube 58 so that as adjustment ring 68 is rotated, slots 64 on outer tube 58 are moved with respect to orifice holes 62. The amount of movement of adjustment ring is preferably calibrated so that the position of adjustment ring can be used to meter the flow of hydraulic fluid 66 through orifice holes 62 and slots 64. Adjustment ring 68 preferably has gears 72 affixed thereto.

A motor having a shaft 76 and a gear 78 mounted thereto is used to provide movement of adjustment ring 68. As shaft 68 rotates, gears 78 on shaft 76 mesh with gears 72 on adjustment ring 68. Adjustment ring 68 moves outer tube 58 relative to inner tube 56 to change the alignment of orifice holes 62 with slots 64. Motor 74 is preferably a stepper motor that can be easily and accurately moved a predetermined amount to ultimately change the pressure a predetermined amount. Other types of motors may be substituted as would be evident to those skilled in the art. Also a shaft 76 and gear 78 arrangement has been shown. A screw drive, worm gear or other method for moving the adjustment ring would be evident to those skilled in the art.

Figure 5:
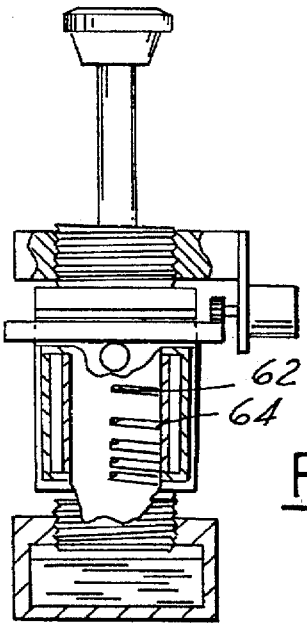
FIG. 5 is a cross sectional view of an adjustable pressure cylinder.

Referring now to FIG. 5, one position of orifice holes 62 with respect to slots 64 is shown. Orifice holes 62 are shown partially aligned with slots 64.

Figure 6:
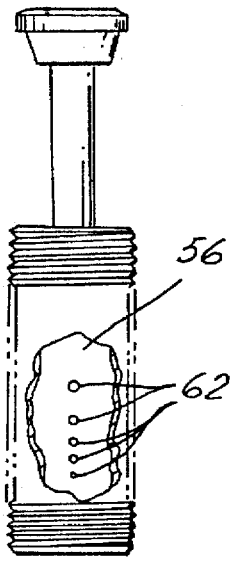
FIG. 6 is a partial cut-away view of the inside of an adjustable pressure cylinder.

Referring now to FIG. 6, inner tube 56 is shown in more detail. As shown, orifice holes 62 progressively decrease in diameter. A changing orifice size may help to linearize the pressure provided over the entire stroke of piston 54. The type of change in the orifice sizes depend ultimately on the final pressure profile desired.

In operation, the press is configured for the desired part. First any old die and pressure set is removed. An adjustable pressure set is placed upon the bed plate of the press. A lower die is placed upon the pressure set and the upper die is secured to the ram. The pressure desired to be obtained between the upper plate 36 and lower plate 38 is placed into computer 30. This may be done for one or many modules 32. The computer 30 communicates with the mechanical servo control 50 to convert the numerical numbers into an electrical command to adjust the pressure. Motor 74 connected to the internal pressure regulating components is rotated to provide the proper area of exposed orifices. Preferably, the outer tube 58 is rotated with respect to the inner tube 56. Each module 32 may have a different required pressure. The material to be stamped is placed upon die and a part 22 is stamped. During the stamping process hydraulic fluid 66 is forced from the inner cylinder through orifice holes 62 and slots 64 into the accumulator 60. To automatically return the hydraulic fluid 66 from accumulator 60 back to inner tube 56, die cylinders 44 apply a pressure to lift upper plate 36 and in turn extend piston 54. Hydraulic fluid 66 is then drawn back into inner tube 58. The pressure set 20 is then ready to stamp other parts.

While the best mode for carrying out the present invention has been described in detail, those familiar with the art to which this invention relates will recognize various alternative designs and embodiments for practicing the invention as defined by the following claims.

What is claimed is:

1. A removable pressure set for placement between a die and a surface of a press comprising:

an upper plate for placement adjacent the die;

a lower plate for placement against the surface of the press;

a pressure cylinder placed between said upper plate and said lower plate;

an adjustable pressure regulator coupled to said cylinder that controls the pressure applied between said upper plate and said lower plate; and a computer controller coupled to said adjustable pressure regulator that communicates to said adjustable pressure regulator to provide a predetermined pressure between said upper plate and lower plate.

2. A pressure set as recited in claim 1, wherein said pressure cylinder contains hydraulic fluid.

3. A pressure set as recited in claim 1, further comprising a plurality of die cylinders mounted between said upper plate and said lower plate.

4. A pressure set as recited in claim 1, further comprising a plurality of die set bushings, said die set bushings being mounted between said upper plate and said lower plate.

5. A pressure set as recited in claim 2, wherein said pressure regulator comprises a plurality of adjustable metering components coupled within said pressure cylinder to control a rate of flow of hydraulic fluid within said pressure cylinder.

6. A pressure set as recited in claim 5, wherein said adjustable metering components comprise a first tube having a plurality of orifices and a second tube having a plurality of metering slots, said first tube and said second tube being relatively adjustable so that an alignment of said slots with said orifices may be changed.

7. A pressure set as recited in claim 6, wherein said pressure cylinder comprises a piston operatively coupled to said upper plate and within said first tube, and a fluid accumulator, so that when a pressure is placed on said upper plate, said piston forces hydraulic fluid to flow though said slots and orifices at a rate of flow depending on said alignment of said slots with said orifices.

8. A pressure set as recited in claim 5, wherein said adjustable pressure regulator comprises an adjuster external to said pressure cylinder and coupled to said adjustable metering components, said adjuster adjusting said adjustable metering components to control said flow.

9. A pressure set as recited in claim 8, wherein said adjuster comprises a first gear concentric with said pressure cylinder.

10. A pressure set as recited in claim 8, wherein said adjustable pressure regulator further comprises a motor and a second gear coupled to said motor, said first gear cooperating with said second gear to adjust said adjustable metering components.

11. A removable pressure set for placement between a die and a surface of a press comprising:

an upper plate for placement adjacent the die;

a lower plate for placement against the surface of the press;

a pressure cylinder placed between said upper plate and said lower plate;

pressure regulating means coupled to said cylinder for remotely controlling a pressure applied between said upper plate and said lower plate; and computer control means coupled to said adjustable pressure regulating means for communicating with said adjustable pressure regulating means to provide a predetermined pressure between said upper plate and lower plate;

said pressure regulating means comprises internal pressure adjustment means coupled within said pressure cylinder for regulating the pressure within said pressure cylinder and external adjustment means coupled to said internal pressure adjustment means for adjusting said internal pressure adjustment means;

said external adjustment means comprises a motor coupled to said internal pressure adjustment means and a first gear coupled to said internal pressure adjustment means and a second gear coupled to said motor, said first gear cooperating with said second gear to adjust said internal adjustment means.

12. A pressure set as recited in claim 11, further comprising a plurality of die cylinders mounted between said upper plate and said lower plate.

13. A pressure set as recited in claim 11, further comprising a plurality of die set bushings, said die set bushings being mounted between said upper plate and said lower plate.

14. A removable pressure set for placement between a die and a surface of a press comprising:

a support frame; and a plurality of pressure modules supported by said frame, each of said pressure modules having independently remotely adjustable pressures;

each of said modules having an upper plate for placement adjacent the die;

a lower plate for placement on the surface of the press;

a pressure cylinder placed between said upper plate and said lower plate; and an adjustable pressure regulator coupled to said cylinder that controls the pressure applied between said upper plate and said lower plate;

said adjustable pressure regulator comprises a plurality of adjustable metering components coupled within said pressure cylinder to control the pressure within said pressure cylinder;

said adjustable metering components comprise a first tube having a plurality of orifices and a second tube having a plurality of metering slots, said first tube and said second tube being relatively adjustable so that an alignment of said slots with said orifices may be changed;

said pressure cylinder comprises a piston operatively coupled to said upper plate and within said first tube, and a fluid accumulator, so that when a pressure is placed on said upper plate, said piston forces a hydraulic fluid to flow though said slots and orifices at a predetermined rate depending on said alignment of said slots with said orifices;

said pressure regulator comprises an adjuster external to said pressure cylinder and coupled to said adjustable metering components;

said adjuster comprises a first gear concentric with said pressure cylinder;

said adjustable pressure regulator further comprises a motor and a second gear coupled to said motor, said first gear cooperating with said second gear to adjust said adjustable metering components.

15. A pressure set as recited in claim 14, further comprising a plurality of die cylinders mounted between said upper plate and said lower plate.

16. A pressure set as recited in claim 14, further comprising a plurality of die set bushings, said die set bushings being mounted between said upper plate and said lower plate.

17. A pressure set as recited in claim 14, further comprising a controller coupled to said adjustable pressure regulator to communicate to said adjustable pressure regulator to provide a predetermined pressure between said upper plate and lower plate.

18. A pressure set as recited in claim 14, further comprising a connector coupled to said frame for electrically coupling said motor to said controller.

19. A pressure set as recited in claim 17, wherein said controller comprises a programmable computer.

20. A stamping press having a lower die comprising:

a press bed;

a ram;

a frame supported by said press bed; and a removable pressure set having a plurality of independently remotely adjustable pressure modules supported by said frame, each of said pressure modules having an upper plate for placement adjacent the lower die;

a lower plate for placement on the press bed;

a pressure cylinder placed between said upper plate and said lower plate; and an adjustable pressure regulator coupled to said cylinder that controls a pressure applied between said upper plate and said lower plate.

21. A stamping press as recited in claim 20, further comprising a plurality of die cylinders mounted between said upper plate and said lower plate.

22. A stamping press as recited in claim 20, further comprising a plurality of die set bushings, said die set bushings being mounted between said upper plate and said lower plate.

23. A stamping press as recited in claim 20, further comprising a controller coupled to said adjustable pressure regulator to communicate to said adjustable pressure regulator to provide a predetermined pressure between said upper plate and lower plate.

24. A stamping press as recited in claim 20, wherein said pressure regulator comprises adjustable metering components coupled within said pressure cylinder to control a pressure within said pressure cylinder.

25. A stamping press as recited in claim 23, wherein said controller comprises a programmable computer.

26. A stamping press as recited in claim 24, wherein said adjustable metering components comprise a first tube having a plurality of orifices and a second tube having a plurality of metering slots, said first tube and said second tube being relatively adjustable so that an alignment of said slots with said orifices may be changed.

27. A stamping press as recited in claim 24, wherein said pressure regulator comprises an adjuster external to said pressure cylinder and coupled to said adjustable metering components.

28. A stamping press as recited in claim 26, wherein said pressure cylinder comprises a piston operatively coupled to said upper plate and within said first tube, and a fluid accumulator, so that when a pressure is placed on said upper plate, said piston forces a hydraulic fluid to flow though said slots and orifices at a predetermined rate depending on said alignment of said slots with said orifices.

29. A stamping press as recited in claim 27, wherein said adjuster comprises a first gear concentric with said pressure cylinder.

30. A stamping press as recited in claim 29, wherein said adjustable pressure regulator further comprises a motor and a second gear coupled to said motor, said first gear cooperating with said second gear to adjust said adjustable metering components.

31. A stamping press as recited in claim 30, further comprising a connector coupled to said frame for electrically coupling said motor to said controller.

32. A method for using a stamping press comprising the steps of:

placing a lower plate of a removable pressure set on a surface of a press, said pressure set having a module with an adjustable pressure cylinder;

placing a die against an upper plate of said pressure set;

remotely adjusting said adjustable pressure cylinders to provide a predetermined pressure between said upper plate and said lower plate during stamping; and stamping a part.

33. A method as recited in claim 32, wherein said pressure set further comprises adjustable metering components, wherein said adjustable metering components comprise a first tube having a plurality of orifices and a second tube having plurality of metering slots, said step of remotely adjusting comprising the steps of moving said first tube relative to said second tube to adjust an alignment of said orifices with said slots.

34. A method as recited in claim 33, wherein said pressure set further comprises a upper plate, a second plate, a piston and an accumulator, said piston operatively coupled to said upper plate and within said first tube, said step of remotely adjusting comprising the steps of placing a pressure on said upper plate, moving said piston in response to said pressure and forcing hydraulic fluid to flow though said slots and orifices at a predetermined rate depending on said alignment of said slots with said orifices.

35. A method as recited in claim 33, wherein said adjustable pressure cylinder comprises a pressure regulator, said pressure regulator comprises an adjuster external to said pressure cylinder and coupled to said adjustable metering components, said adjuster comprises a first gear concentric with said pressure cylinder, said adjustable pressure regulator further comprises a motor and a second gear coupled to said motor, said step of remotely adjusting further comprising energizing said motor, rotating said second gear, rotating said first gear and thereby adjusting said adjustable metering components.

* * * * *